United States Patent [19]

Ogilvie

[11] Patent Number: 4,870,769

[45] Date of Patent: Oct. 3, 1989

[54] SIGN

[75] Inventor: David P. Ogilvie, Alyth, Scotland

[73] Assignee: Signaid Limited, Dundee, Scotland

[21] Appl. No.: 151,005

[22] Filed: Feb. 1, 1988

[30] Foreign Application Priority Data

Jan. 31, 1987 [GB] United Kingdom ..... 8702185
Mar. 26, 1987 [GB] United Kingdom ..... 8707263

[51] Int. Cl.[4] ..... G09F 13/04
[52] U.S. Cl. ..... 40/564; 40/605
[58] Field of Search ..... 40/605, 152, 564; 52/201, 288; 160/135

[56] References Cited

U.S. PATENT DOCUMENTS 2,728,957 1/1956 Keller ..... 52/288
3,466,777 9/1969 Wistrand et al. ..... 40/605
3,852,901 12/1974 Woodle et al. ..... 40/605
4,030,219 6/1977 Donovan ..... 40/605
4,166,332 9/1979 Donovan ..... 40/605

FOREIGN PATENT DOCUMENTS 776352 1/1968 Canada ..... 52/288
2167797 6/1986 United Kingdom ..... 52/288

*Primary Examiner*—Gene Mancene
*Assistant Examiner*—Cary E. Stone

[57] ABSTRACT

A frame member having first and second faces at right angles to one another and recesses in the faces for receiving panels or the like for producing a sign having the frame members as a surround. Each face has at least two recesses and the sign can be in the form of a cuboid.

8 Claims, 3 Drawing Sheets

SIGN

This invention relates to a sign.

BACKGROUND OF THE INVENTION

There is considerable demand for commercial and industrial signs in the form of cuboids which house light sources, the walls of the signs being of translucent material such as perspex which carries the wording or artwork of the sign. In satisfying this demand it has previously been necessary to make a custom-built frame to extend around and support the edges of the sign, and this has proved expensive and time-consuming.

SUMMARY OF THE INVENTION

According to the present invention there is provided an elongate member comprising a body having a longitudinal axis, a first face on the body, a second face on the body and directed generally at right angles to the first face, first and second recesses in the first face and extending parallel to the longitudinal axis of the body, third and fourth recesses in the second face and extending parallel to the longitudinal axis of the body, the first and third recesses having non-uniform profiles in cross-section.

Preferably, the frame members provide a framework for a sign in the form of a cuboid, wherein the frame members extend between wall members and engage side edges of the wall members in at least said first and third recesses, the wall members having edge portions having a non-uniform profile to engage and be retained against the non-uniform profile of the respective recess.

Preferably at least a part of at least one of the wall members is translucent and the sign houses a light source. The translucent wall member can then carry wording or artwork which is highlighted on actuation of the light source.

Preferably also the non-uniform profiles are provided by inwardly extending flanges which provide supports for the wall members which may be provided with a lip along at least one edge.

Each frame member may have a longitudinal recess into which a leg of a three-legged corner piece may fit, the legs of the corner piece extending at right angles to one another so that the cuboidal form of the frame may be assembled with eight corner pieces and six wall members.

Preferably, the first and third recesses each have a flange which constricts an opening of said respective recess at the respective first and second face of the body.

Preferably also, the body is symmetrical about an axis passing through an intersection of said first and second faces.

The second and fourth recesses may coincide at the intersection of the first and second faces.

Preferably, said first recess has an opening whose cross-sectional extent in a direction at right angles to said longitudinal axis of the body is in the ratio of from 1:3 to 1:9 of the cross-sectional extent of said first face. The ratio is most preferably from 1:5 to 1:7.

The profile of each of the first and third recesses may of advantage be generally rectangular viewed in cross-section in a direction at right angles to the longitudinal axis of the body, said rectangular profile being breached along one side to provide an opening for the recess.

BRIEF DESCRIPTION OF THE DRAWINGS

Embodiments of the present invention will now be described with reference to the accompanying drawings in which.

DESCRIPTION OF PREFERRED EMBODIMENT

Figure 1:
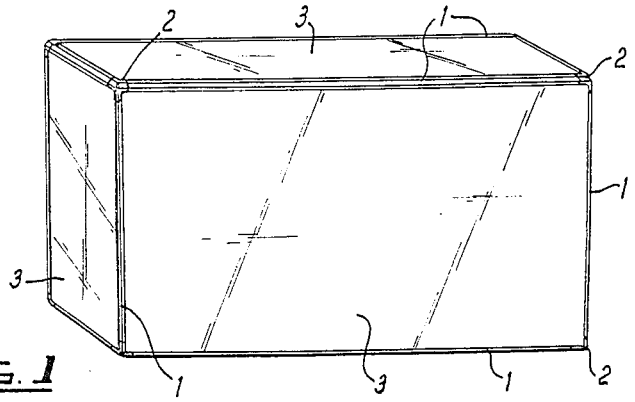
FIG. 1 is a perspective view of a sign of the present invention.
Figure 2:
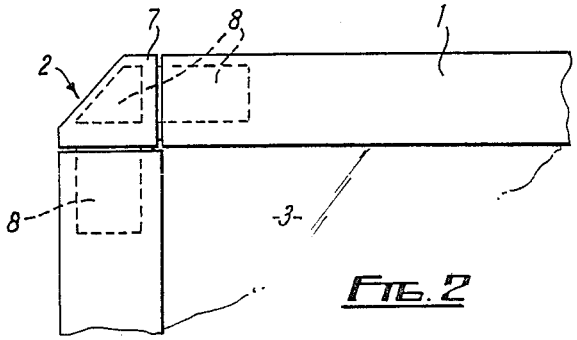
FIG. 2 is an end view of a corner joint of the sign of FIG. 1.
Figure 3:
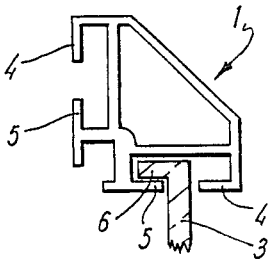
FIG. 3 is an end view of a frame member for use in the sign of FIG. 1.

Referring to the drawings, the sign of the embodiment of the invention shown in FIGS. 1 to 3 comprises generally triangular-section frame members 1 of extruded aluminium interconnected by corner pieces 2 to form a cuboidal framework. Translucent perspex sheets 3 extend between the frame members 1 to provide walls for the sign, and several of the sheets 3 bear advertising material. A light bulb, or a fluorescent or neon tube (not shown) is mounted within the sign for illumination.

The frame members 1 have along two adjacent faces inwardly-directed flanges 4, 5 and the sheets 3 have along their edges lips 6 which correspond with the flanges 5, so that the sheets 3 are suspended at their edges on the flanges 4. Each of the corner pieces 2 has a body portion 7 from which extend at mutual right-angles legs 8 of complementary profile to recesses in the frame members 1.

Figure 4:
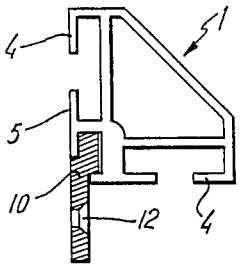
FIG. 4 is an end view of a frame member being used for a two dimensional sign.
Figure 5:
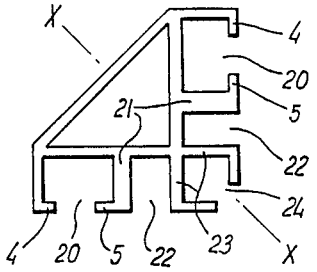
FIG. 5 is an end view of an alternative embodiment of the frame member of this invention.

If required, the frame members 1 and sheets 3 can be used to form a two-dimensional sign for fixing to a wall, in which case the corner pieces are modified to have only two legs 8. To fix the sign to the wall fixing brackets 10 (FIG. 4) are slid along a recess on one face of the frame member adjacent the wall, to support the frame member at spaced intervals. The brackets 10 are apertured at 12 to receive screws which are inserted into the wall, and the brackets can be moved along the frame member 1 to any suitable location.

Referring now to FIGS. 5 to 11, the extruded aluminium frame member is symmetrical about an axis "X" (FIG. 5) and has along each of two adjacent faces a recess 20 whose mouth is part-closed by inwardly-directed flanges 4 and 5, as in FIG. 1. A second recess 22 is provided along each face, having a side wall 21 which is common to the recess 20. The opposite side wall 23 of the recess 22 is common to a further recess 24 running along the junction of said adjacent faces of the frame member.

Figure 6:
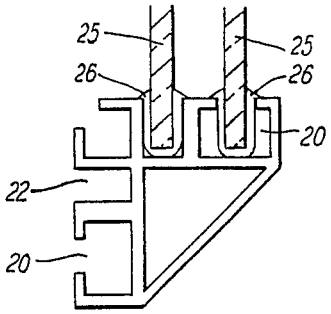
FIG. 6 is an end view of the frame member of FIG. 5 being used to provide a double glazing unit.

In FIG. 6 a pair of sheets of glass 25 are held in the recesses 20, 22 to provide a double glazing unit, for example for use as a door of a refrigerated cabinet, and rubber extrusions 26 form channels which receive the sheets 25 in the recesses 20, 22 to hold them firmly and provide a seal between the sheets 25 and the frame member.

Figure 7:
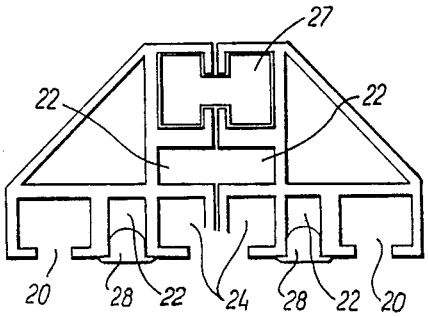
FIG. 7 is an end view of a pair of the frame members of FIG. 5 joined together to provide support for two signs adjacent one another.
Figure 7A:
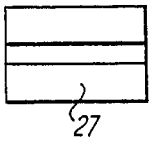
FIG. 7A is a plan view of a jointing piece used in the arrangement of FIG. 7.

In FIG. 7 two frame members are shown conjoined by means of a jointing piece 27 which is in the form of a short piece of plastics material as shown in side view in FIG. 7A inserted in the recesses 20 of the adjacent frame members. The recesses 20, 22 on the rear faces of the frame members can then be used to support glass, plastics, wood or other sheets for providing signs exposed in opposite directions. The recess 22 is shown blanked off in FIG. 7 by means of a strip of extruded rubber 28 which fits within the recess and provides a neat and effective manner of closing the recess when not required. The strip 28 could alternatively be fitted to the recess 20.

Figure 8:
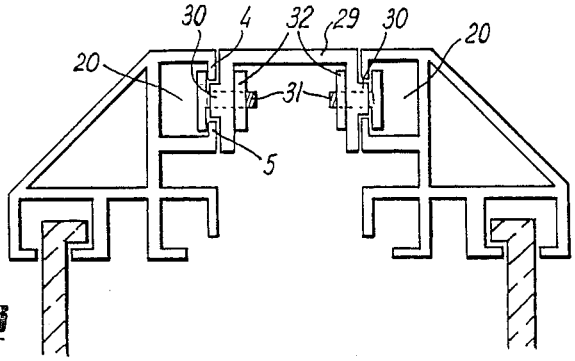
FIG. 8 is an end view of a pair of frame members of FIG. 5 joined together to provide a double-sided sign.

In FIG. 8 a double-sided sign is provided by disposing a channel member 29 between the frame members to space them apart sufficiently to allow a fluorescent tube or other light source to be installed within the sign. The channel member 29 has a pair of opposed lugs 30 which locate between the flanges 4, 5 of the recesses 20, and is secured to the frame members by bolts 31 passing through the channel member 29 at intervals along its length. The heads of the bolts 31 are held between the flanges 4 and 5 and nuts 32 are screwed onto the bolts 31 from within the channel members 29.

Figure 9:
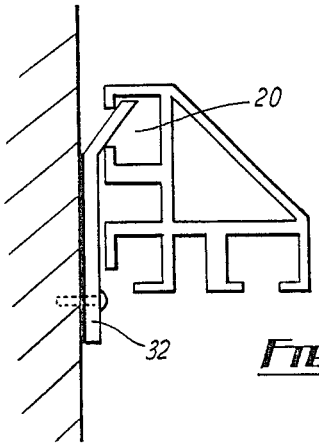
FIG. 9 is an end view of the frame member of FIG. 5 fixed to a support.

In FIG. 9 the frame member is fixed to a wall or other support by brackets 32 screwed to the wall at intervals, the bracket 32 having an outwardly-angled flange on which the frame member is hung by engagement in the recess 20. This fixing method is very useful when the frame member is long, as it can be easily engaged over the brackets 32.

Figure 10:
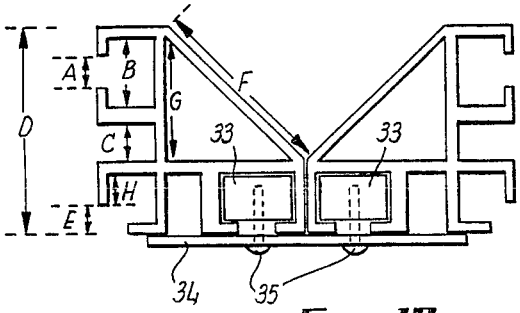
FIG. 10 is an end view of a pair of the frame members of FIG. 5 joined together in an alternative manner to FIG. 7.
Figure 10A:
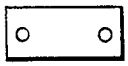
FIG. 10A is a side view of a strip used in the arrangement of FIG. 10.

In FIG. 10 each frame member has short metal strips 33 inserted at intervals along its recess 20. The strip 33 is shown in side view in FIG. 10A. A plate 34 spans between the strips 33 and is secured to each of them by screws 35.

Figure 11:
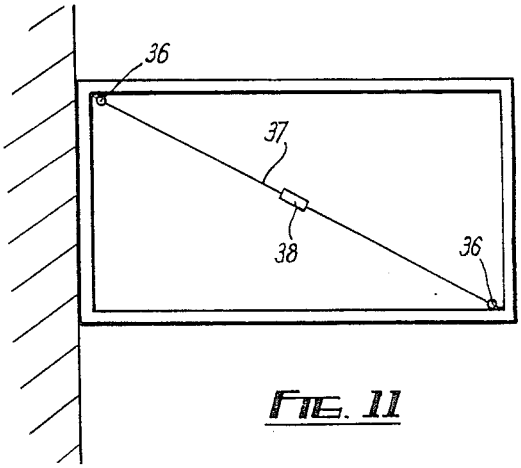
FIG. 11 is a side view of a sign cantilevered from a support.

FIG. 11 shows a cuboidal sign structure secured to and extending outwardly from a vertical supporting wall. Traditionally such signs have tended to sag at the outer end, and this is overcome in the present case by inserting an anchorage, which carries an eye 36, into the recess 20 of the upper frame member at the wall, and a corresponding anchorage into the recess 20 of the lower frame member remote from the wall. A wire 37 is secured to the eyes 36 of the anchorages so as to extend diagonally of the structure, and an adjustment screw 38 mid-way along the wire 37 allows it to be tightened, thereby supporting the outer end of the sign and preventing sagging.

In this embodiment of the invention the dimensions of the frame member shown in FIG. 10 are as follows:

A—6 mm
B—12.5 mm
C—6 mm
D—35 mm
E—5 mm
F—34 mm
G—21 mm
H—5 mm

Modifications and improvements may be incorporated without departing from the scope of the invention.

I claim:

1. An elongate frame member in the form of a body having a longitudinal axis and being of uniform cross-section transverse to said longitudinal axis along the length of the body; said body comprising:

a first face;

a second face directed generally at right angles to said first face;

a first recess formed in said first face and bounded at said first face by a pair of flanges defining a first slot therebetween;

a second recess formed in said second face and bounded at said second face by a pair of flanges defining a second slot therebetween, whereby mutually perpendicular panel members can be received in said first and second slots; and a corner recess at the junction of said first and second faces and bounded at each of said faces by a single flange such that said corner recess is open in directions perpendicular to both of said first and second faces.

2. The frame member of claim 1, in which the ends of said first and second faces remote from said junction are interconnected by a substantially planar web to make said cross-section substantially triangular.

3. The frame assembly of claim 1, further including a third recess formed in said first face intermediate said first recess and said corner recess; and a fourth recess formed in said second face intermediate said second recess and said corner recess.

4. The frame member of claim 3, in which said third and fourth recesses are of open rectangular form.

5. The frame member of claim 4, in which one side of the third recess is formed by a wall which also defines one side of the first recess, and an opposed side of the third recess is formed by a wall which also defines one side of the corner recess; and in which one side of the fourth recess is formed by a wall which also defines one side of the second recess, and an opposed side of the fouth recess is formed by a wall which also defines another side of the corner recess.

6. The frame member of claim 1, in which one side of the first recess is formed by a wall which also defines one side of the corner recess, and one side of the second recess is formed by a wall which also defines another side of the corner recess.

7. The frame member of claim 1, in which said body, in said transverse cross-section, is symmetrical about a line bisecting the junction of said first and second faces.

8. A sign in the form of a cuboid, comprising a plurality of elongate frame members, each frame member being in the form of a body having a longitudinal axis and being of uniform cross-section transverse to said longitudinal axis along the length of the body; said body comprising:

a first face;

a second face directed generally at right angles to said first face;

a first recess formed in said first face and bounded at said first face by a pair of flanges defining a first slot therebetween;

a second recess formed in said second face and bounded at said second face by a pair of flanges defining a second slot therebetween, whereby mutually perpendicular panel members can be received in said first and second slots; and a corner recess at the junction of said first and second faces and bounded at each of said faces by a single flange such that said corner recess is open in directions perpendicular to both of said first and second faces;

the sign further comprising wall members arranged to define a cuboid, said wall members having opposed edge portions each engaged in one of the first and second recesses of a respective frame member, each said edge portion being shaped to engage behind a flange of said one of the recesses.

* * * * *